US008084702B2

(12) United States Patent
Kawarago

(10) Patent No.: US 8,084,702 B2
(45) Date of Patent: Dec. 27, 2011

(54) IMAGE FORMING APPARATUS

(75) Inventor: Atsushi Kawarago, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 346 days.

(21) Appl. No.: 12/546,474

(22) Filed: Aug. 24, 2009

(65) Prior Publication Data

US 2010/0051426 A1 Mar. 4, 2010

(30) Foreign Application Priority Data

Aug. 26, 2008 (JP) ..... 2008-216697

(51) Int. Cl.
*H01H 3/16* (2006.01)

(52) U.S. Cl. ..... 200/50.1

(58) Field of Classification Search ..... 200/50.1, 200/331, 333, 61.62, 61.73, 5 A, 5 R
See application file for complete search history.

(56) References Cited

U.S. PATENT DOCUMENTS

| | | | | |
|---|---|---|---|---|
| 4,978,817 | A * | 12/1990 | Honda | 200/50.1 |
| 7,511,238 | B2 * | 3/2009 | Sugane et al. | 200/61.62 |
| 7,728,241 | B2 * | 6/2010 | Ito | 200/331 |

FOREIGN PATENT DOCUMENTS

| | | |
|---|---|---|
| JP | 62-125176 | 6/1987 |
| JP | 2-129565 | 5/1990 |
| JP | 3-044653 | 2/1991 |
| JP | 3-044654 | 2/1991 |
| JP | 4-301657 | 10/1992 |
| JP | 8-285183 | 11/1996 |
| JP | 2000-028146 | 1/2000 |
| JP | 2001-343791 | 12/2001 |

* cited by examiner

*Primary Examiner* — Edwin A. Leon

(57) ABSTRACT

Disclosed in an apparatus in which an actuating member provided for an opening and closing member actuates a switch provided for a main body of the apparatus. The apparatus includes a protecting member protecting the switch and a restricting member restricting an object entering an opening of the protecting member. The restricting member has an opening smaller than the opening of the protecting member. The restricting member is movable in the direction intersecting the direction in which the actuating member passes through the opening of the restricting member. The opening of the restricting member is reduced in size to prevent an accidental operation while being insusceptible to a space in the apparatus or deformation of the apparatus.

9 Claims, 4 Drawing Sheets

IMAGE FORMING APPARATUS

BACKGROUND OF THE INVENTION

1. Field of the Invention

The present invention relates to interlock switch mechanisms, and in particular, relates to an image forming apparatus, such as a copier or a printer, including an interlock switch mechanism.

2. Description of the Related Art

Conventional business machines, such as copiers and printers, include an interlock switch. Such a business machine has a structure in which a projection provided for an opening and closing member presses the switch provided for a main body of the machine.

Accordingly, when a cover is opened upon, for example, maintenance, the projection is apart from the switch, thus restricting the operation of the machine.

Some of the conventional business machines further include a protector that covers the switch and its surrounding portion. The protector has a guide hole through which the projection for pressing the switch can extend, thus preventing an operator from accidentally pressing the switch when opening the cover.

Recently, it has been demanded that the guide hole should be reduced in size in order to more effectively prevent the business machine from being accidentally operated.

Naturally, the guide hole has to have such a shape (size) that the projection can extend through. In addition, it is necessary in terms of manufacturing and structural variations to create a clearance between the projection and the guide hole while the projection extends through the guide hole.

Accordingly, there is a limit to reduce the shape of the guide hole. The interlock switch mechanism has to be further devised.

SUMMARY OF THE INVENTION

The present invention provides an image forming apparatus that prevents a switch from being accidentally actuated.

According to an aspect of the present invention, an image forming apparatus includes a main body of the apparatus, an opening and closing member openably provided for the main body, a switch configured to switch the apparatus between an electrically operating state and a non-operating state, an actuating member configured to actuate the switch. The switch is provided for either one of the main body and the opening and closing member and the actuating member is provided for the other one. The apparatus further includes a protecting member configured to protect the switch. The protecting member has an opening through which the actuating member passes. The apparatus further includes a restricting member configured to restrict an object entering the opening of the protecting member. The restricting member is placed between the protecting member and the switch and has an opening through which the actuating member passes. The opening of the restricting member is smaller than the opening of the protecting member. The restricting member is movable relative to the protecting member and the moving direction of the restricting member intersects the direction in which the actuating member passes through the opening of the restricting member.

According to another aspect of the present invention, an image forming apparatus includes a main body of the apparatus, an opening and closing member openably provided for the main body, a switch configured to switch the apparatus between an electrically operating state and a non-operating state, and an actuating member configured to actuate the switch. The switch is provided for either one of the main body and the opening and closing member and the actuating member is provided for the other one. The apparatus further includes a protecting member configured to protect the switch. The protecting member has an opening through which the actuating member passes. The actuating member is movable relative to the protecting member and the moving direction of the actuating member intersects the direction in which the actuating member passes through the opening of the protecting member.

Further features of the present invention will become apparent from the following description of exemplary embodiments with reference to the attached drawings.

DESCRIPTION OF THE EMBODIMENTS

Exemplary preferred embodiments of the present invention will be described below with reference to the drawings. The dimension, material, and shape of each component which will be described in the following embodiments and the relative configuration of components have to be appropriately changed depending on the configuration of an apparatus to which the present invention is applied and various conditions. The embodiments are not intended to restrict the scope of the invention.

Figure 1:
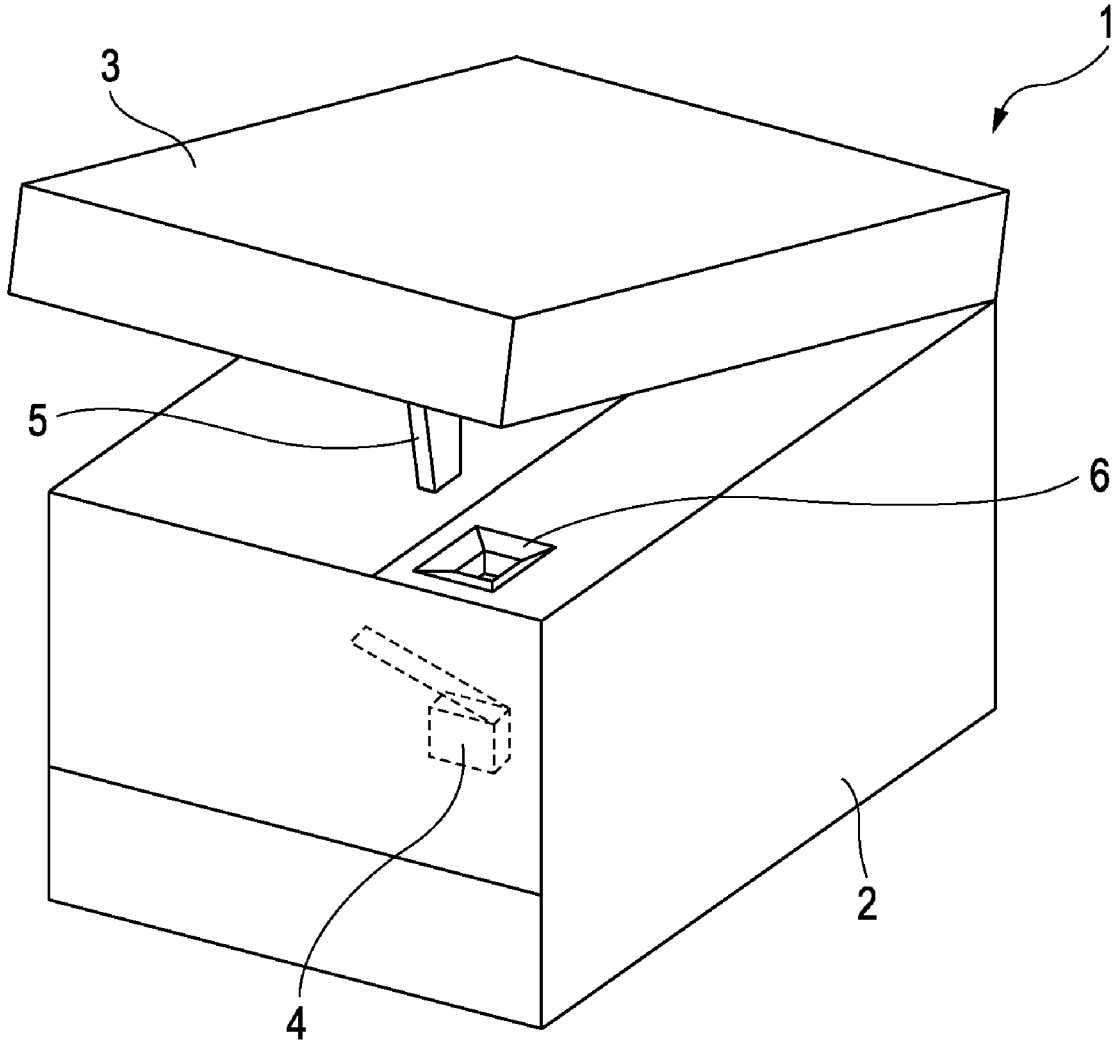
FIG. 1 is a diagram illustrating an image forming apparatus according to an embodiment of the present invention.
Figure 4:
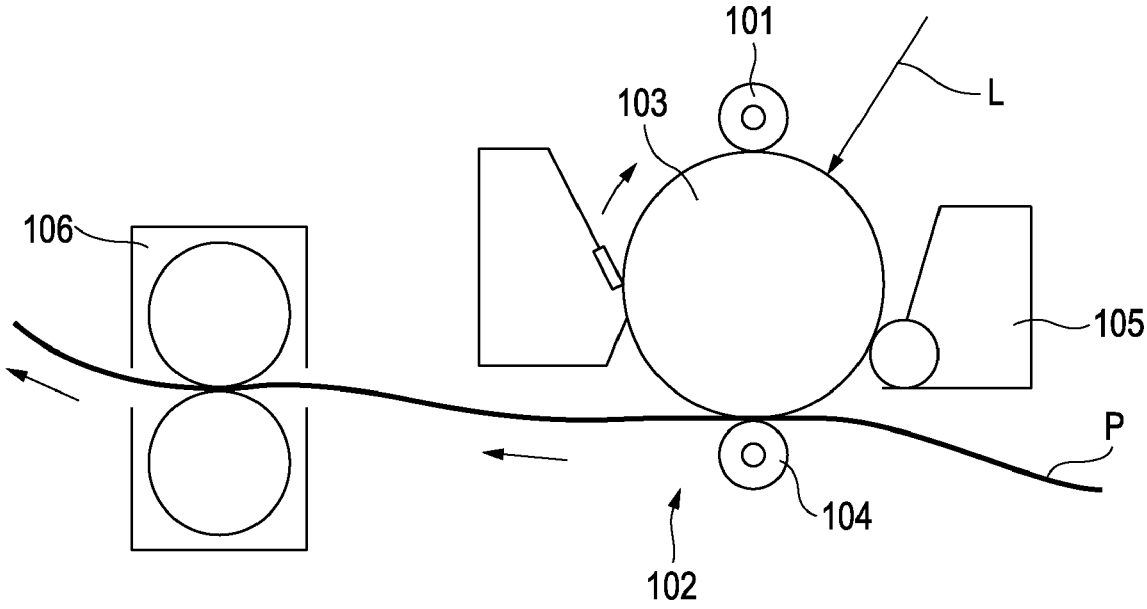
FIG. 4 is a diagram illustrating an image forming apparatus to which the present invention is applicable.

FIG. 1 is a schematic perspective view of a printer 1, serving as an image forming apparatus (electronic device) including an interlock switch mechanism according to an embodiment of the present invention. FIG. 4 is a cross-sectional view of the schematic configuration of the printer 1 according to the present embodiment.

The image forming apparatus as the printer 1 in the present embodiment and an operation of the apparatus will now be described with reference to FIG. 4.

Referring to FIG. 4, an image forming section 102 forms an image using electrophotography. The image forming section 102 includes a photosensitive drum 103, a charging roller 101, a developing device 105, and a transfer roller 104. The photosensitive drum 103 serves as an image bearing member on which a toner image (developer image) is formed. The charging roller 101 charges the photosensitive drum 103. The developing device 105 develops a latent image on the photosensitive drum 103 using a toner. The transfer roller 104 transfers the toner image formed on the photosensitive drum 103 onto a recording material P.

When an image forming operation is started in the image forming section 102 with the above-described configuration, the photosensitive drum 103 is first charged by the charging roller 101. The photosensitive drum 103 is then irradiated with light L corresponding to an image signal by a laser scanner. The irradiation with the light L causes a latent image to be formed on the photosensitive drum 103.

Subsequently, the latent image formed on the photosensitive drum 103 is developed using a toner, serving as a developer, stored in the developing device 105 including a toner cartridge, so that a toner image (visible image) is formed on the photosensitive drum 103. Simultaneously with the toner-image forming operation, a recording material P is fed from a recording-material storage cassette. Accordingly, the recording material P is conveyed to a transfer portion including the photosensitive drum 103 and the transfer roller 104 through a conveying roller and a registration roller synchronously with the toner image formed on the photosensitive drum 103.

In the transfer portion, the transfer roller 104 is biased, thus transferring the toner image onto the recording material P.

After that, the recording material P on which the toner image is transferred is conveyed to a fixing device 106. The fixing device 106 heats and pressurizes the recording material P, thus fixing the toner image onto the recording material P.

The interlock switch mechanism in accordance with the present embodiment will now be described. As for an interlock switch, for example, when a cover of the image forming apparatus is opened, the interlock switch turns off a power supply circuit in the apparatus. Specifically, this switch causes the apparatus to switch between an electrically operating state and a non-operating state.

Referring to FIG. 1, the printer 1 includes a main body (hereinafter, also referred to as "printer main body") 2 of the printer, serving as the image forming apparatus or electronic device, and a cover 3, serving as an opening and closing member, openably provided for the printer main body 2. The cover 3 is opened when an operator performs maintenance.

The printer main body 2 is provided with a switch 4 which is different from a power switch (not shown). The switch 4 includes a switching portion 4*a*. Furthermore, the cover 3 is provided with a projection 5, serving as a switch actuating portion, which comes into contact with (actuates) the switching portion 4*a* when the cover 3 is closed, thus pressing (closing) the switch 4.

When the cover 3 is opened, the projection 5 moves away from the switching portion 4*a* to turn off (open) the switch 4, thus restricting the operation of the printer 1.

As described above, the printer 1 has the interlock switch mechanism in which the projection 5 moves away from or comes into contact with the switching portion 4*a* in accordance with the opening or closing operation of the cover 3 to open or close the switch 4.

In addition, the printer main body 2 is provided with a protector 6 such that the protector 6 covers the switch 4. The protector 6 serves as a protecting member for preventing the operator from accidentally touching the switch 4 when the cover 3 is opened.

A sequence of states after the cover 3 is opened until the cover 3 is closed and the projection 5 presses the switching portion 4*a* to thereby actuate the switch 4 will now be described with reference to FIGS. 2A to 2C.

Figure 2A:
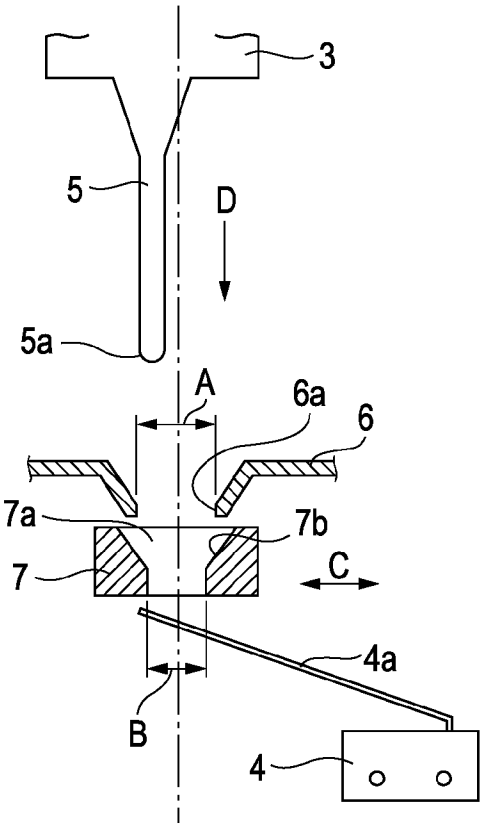
FIGS. 2A to 2C are diagrams illustrating an interlock switch mechanism according to states of a cover in the embodiment of the present invention.

FIG. 2A is a schematic cross-sectional view of the interlock switch mechanism in the state in which the cover 3 of the printer 1 shown in FIG. 1 is opened. FIG. 2B is a schematic cross-sectional view of the interlock switch mechanism in the state in which the cover 3 of the printer 1 in FIG. 1 starts to be closed. FIG. 2C is a schematic cross-sectional view of the interlock switch mechanism in the state in which the cover 3 of the printer 1 in FIG. 1 is closed.

Referring to FIG. 2A, the protector 6 has a guide hole 6*a*, serving as a through-hole (opening) and having a width A, through which the projection 5 provided for the cover 3 can extend.

Figure 2B:
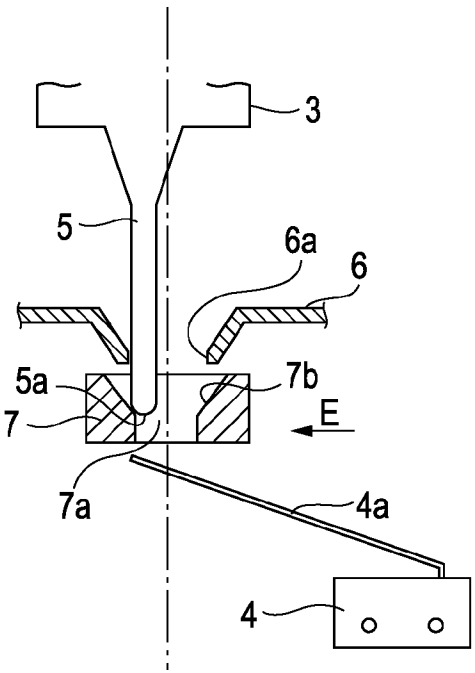
Figure 2C:
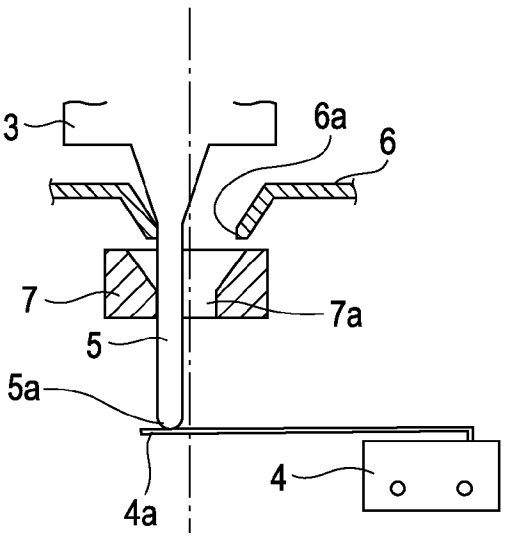

The guide hole 6*a* has such a shape that the projection 5 provided for the cover 3 can extend through the guide hole 6*a* and come into contact with the switching portion 4*a* even when the projection 5 is deviated from its original path (movement path), shown by a long and short dash line in each of FIGS. 2A to 2C, upon opening/closing of the cover 3 due to manufacturing and structural variations, a space between components, or deformation of the components.

In this instance, although the protector 6 can protect an adult's finger, there is a fear that something else thinner than an adult's finger extends through the guide hole 6*a* and comes into contact with the switch 4. In order to more effectively prevent an accidental operation, the mechanism has to be further devised.

According to the present embodiment, as shown in FIG. 2A, a restricting member 7 is held between the protector 6 and the switch 4 (switching portion 4*a*) in the printer main body 2 such that the restricting member 7 is movable relative to the protector 6 in the direction shown by the arrow C. The restricting member 7 has a restriction hole (opening) 7*a* having such a shape (size) that the projection 5 can extend through the restriction hole 7*a* but something relatively thin does not extend therethrough. Specifically, the width B of the restriction hole 7*a* of the restricting member 7 is smaller than the width A of the guide hole 6*a* of the protector 6. In this instance, the direction shown by the arrow C intersects the extending direction in which the projection 5 extends through the restriction hole 7*a* (the moving direction in which the projection 5 moves when extending through the restriction hole 7*a*). More preferably, the direction shown by the arrow C is orthogonal to the extending direction.

In the present embodiment, the shape of the restriction hole 7*a* is rectangular, slit-shaped. As shown in FIG. 2A, the width B along the short sides of the rectangular slit-shaped restriction hole 7*a* is smaller than a finger of the operator so that the operator's finger does not enter (extend through) the restriction hole 7*a*.

The restricting member 7 further has a tapered portion 7*b*, serving as upper inner walls, in the restriction hole 7*a*.

The tapered portion 7*b* is shaped so as to gradually reduce downward in the extending direction in which the projection 5 moves when being inserted into (extending through) the restriction hole 7*a*. The extending direction (moving direction) in which the projection 5 moves when extending through the restriction hole 7*a* is shown by the arrow D in FIG. 2A.

In the present embodiment, as shown in FIGS. 2A to 2C, in the rectangular slit-shaped restriction hole 7*a*, opposed faces including the long sides of the hole are inclined. The structure of the restriction hole 7*a* is not limited to the above structure. In other words, the restriction hole 7*a* may be formed so that the width of the restriction hole 7*a* in at least one of the directions orthogonal to the extending direction (shown by the arrow D) in which the projection 5 moves when extending through the restriction hole 7*a* gradually reduces downward shown by the arrow D. In this case, the one direction is a direction in which the projection 5 provided for the cover 3 may be deviated from its original path, shown by the long and short dash line in each of FIGS. 2A to 2C, upon opening/closing of the cover 3 due to manufacturing variations, a space between the components, or the deformation of the components.

The state in which the cover 3 is closed will now be described.

When the cover 3 starts to be closed, as shown in FIG. 2B, a contact portion 5*a* of the projection 5 comes into contact with the tapered portion 7*b* of the restricting member 7. Since the restricting member 7 is held movably relative to the protector 6, the restricting member 7 is moved in the direction indicated by the arrow E shown in FIG. 2B by a component of a force applied by the contact portion 5*a*. Thus, the restricting member 7 is moved to a position where the projection 5 can extend through the restriction hole 7*a*.

When the cover 3 is closed, as shown in FIG. 2C, the projection 5 extends through the restriction hole 7*a* of the restricting member 7 and the contact portion 5*a* comes into contact with the switching portion 4*a* of the switch 4, so that the switch 4 is closed. Thus, the printer 1 becomes operative.

According to the present embodiment, with the above-described structure, even when a hole through which the projection 5 can be inserted is reduced in size, the projection 5 can extend through the restriction hole 7*a* without being affected by manufacturing and structural variations, a space between the components, or the deformation of the components, thus actuating the switch 4.

Furthermore, in the present embodiment, the mechanism is designed so as to prevent a child's finger from entering a switch part, thus preventing an accidental operation caused by a child when the child accidentally inserts his or her finger into the switch part. Advantageously, the printer can be prevented from operating while a child accidentally inserts his or her finger into the switch part.

As described above, the present embodiment provides the inexpensive interlock switch mechanism which can prevent the operator from accidentally operating the switch and is insusceptible to product manufacturing and structural variations.

In the present embodiment, as shown in FIGS. 2A to 2C, the mechanism is designed so that the projection 5 directly presses the switch 4. The mechanism is not limited to this structure. Specifically, a linking member (e.g., a linking member 17 in another embodiment which will be described later) may be placed between the projection 5 and the switch 4. In this case, the same advantages as those in the present embodiment can be obtained. The placement of the linking member permits the switch 4 to be appropriately disposed in a more favorable position. Advantageously, an interlock switch mechanism with higher design flexibility can be provided.

In the present embodiment, the switch 4 is provided for the printer main body 2 and the projection 5 is provided for the cover 3. The arrangement is not limited to the above case. In other words, the switch 4 may be provided for either one of the printer main body 2 and the cover 3 and the projection 5 may be provided for the other one.

Another embodiment of the present invention will be described below. The configuration of a printer according to this embodiment is the same as that in the above-described embodiment. The same components as those in the foregoing embodiment are designated by the same reference numerals and explanation of the previously described components is omitted.

A sequence of states after the cover 3 is opened until the cover 3 is closed and the projection 5 presses the switching portion 4*a* to thereby actuate the switch 4 will be described with reference to FIGS. 3A to 3C.

Figure 3A:
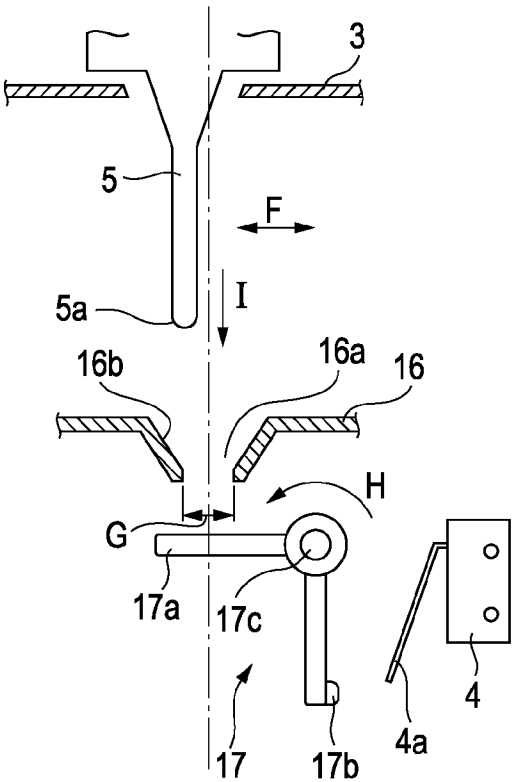
FIGS. 3A to 3C are diagrams illustrating an interlock switch mechanism according to states of a cover in another embodiment of the present invention.

FIG. 3A is a schematic cross-sectional view of an interlock switch mechanism in a state in which the cover 3 is opened in the present embodiment. FIG. 3B is a schematic cross-sectional view of the interlock switch mechanism in a state in which the cover 3 starts to be closed. FIG. 3C is a schematic cross-sectional view of the interlock switch mechanism in a state in which the cover 3 is closed.

As shown in FIG. 3A, the projection 5 is held movably relative to the cover 3 in the direction shown by the arrow F. In this instance, the direction shown by the arrow F is a direction intersecting the extending direction in which the projection 5 extends through a restriction hole 16*a* which will be described below (the moving direction in which the projection 5 moves when extending through the restriction hole 16*a*). More preferably, the direction shown by the arrow F is orthogonal to the extending direction.

The printer main body 2 includes a protector 16, serving as a protecting member for preventing the operator from accidentally touching the switch 4 when the cover 3 is opened. In the present embodiment, as shown in FIG. 3A, the protector 16 has the restriction hole 16*a*, having a width G, through which the projection 5 provided for the cover 3 extends.

Figure 3B:
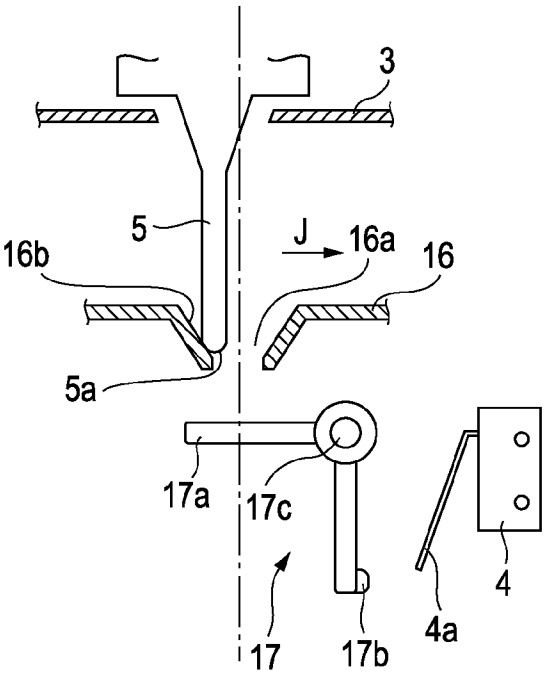
Figure 3C:
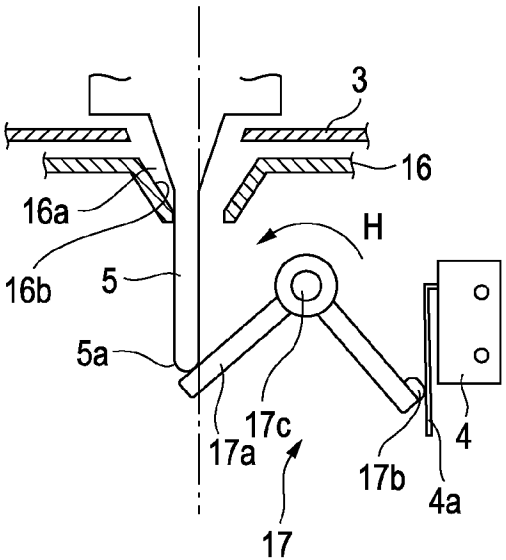

The restriction hole 16*a* has such a shape that even when the projection 5 is deviated from its original path (movement path), indicated by a long and short dash line in each of FIGS. 3A to 3C, upon opening/closing of the cover 3 due to manufacturing variations, a space between components, or deformation of the components, the projection 5 can extend through the restriction hole (opening) 16*a* and come into contact with the linking member 17.

In this instance, the protector 16 has a tapered portion 16*b*, serving as upper inner walls, in the restriction hole 16*a*. The tapered portion 16*b* is designed so as to gradually reduce downward in the extending direction (indicated by the arrow I in FIG. 3A) in which the projection 5 moves when extending through the restriction hole 16*a*.

When the projection 5 is inserted into the restriction hole 16*a*, the projection 5 is moved relative to the cover 3 while being guided by the tapered portion 16*b* provided for the entrance of the restriction hole 16*a*. Thus, the projection 5 extends through the restriction hole 16*a*.

In the present embodiment, the restriction hole 16*a* of the protector 16 has such a shape (size) that a finger of the operator does not extend through the restriction hole 16*a*.

In the present embodiment, the shape of the restriction hole 16*a* is rectangular, slit-shaped in a manner similar to the foregoing embodiment. As shown in FIG. 3A, the width G on the short sides of the rectangular slit-shaped restriction hole 16*a* is thinner than a finger of the operator so that the operator's finger does not enter the restriction hole 16*a* (extend through the restriction hole 16*a*).

In the present embodiment, as shown in FIGS. 3A to 3C, in the rectangular slit-shaped restriction hole 16*a*, opposed faces including the long sides are inclined. The structure of the restriction hole 16*a* is not limited to the above structure. In other words, the restriction hole 16*a* may be formed so that the width of the restriction hole 16*a* in at least one of the directions orthogonal to the extending direction (shown by the arrow I) in which the projection 5 moves when extending through the restriction hole 16*a* gradually reduces downward shown by the arrow I. In this case, the one direction is a direction in which the projection 5 provided for the cover 3 may be deviated from its original path, shown by the long and short dash line in each of FIGS. 2A to 2C, upon opening/closing of the cover 3 due to manufacturing variations, a space between the components, or the deformation of the components.

In the present embodiment, the linking member 17 is placed between the protector 16 and the switch 4. The linking member 17 includes a first contact portion 17*a* which can come into contact with the projection 5 and a second contact portion 17*b* which can come into contact with the switching portion 4*a* of the switch 4. The linking member 17 is rotatably attached to a shaft 17*c*. The projection 5 extending through the restriction hole 16*a* presses the first contact portion 17*a* to rotate the linking member 17 in the direction shown by the arrow H, so that the second contact portion 17*b* comes into contact with the switching portion 4*a* of the switch 4.

The state in which the cover 3 is closed will now be described.

When the cover 3 starts to be closed, as shown in FIG. 3B, the contact portion 5*a* of the projection 5 comes into contact with the tapered portion 16*b* in the restriction hole 16*a* of the protector 16. Since the projection 5 is held movably relative to the cover 3, the projection 5 is moved in the direction indicated by the arrow J in FIG. 3B by a component of a force applied by the tapered portion 16*b*. Thus, the projection 5 is moved to a position where the projection 5 can extend through the restriction hole 16*a*.

Furthermore, when the cover 3 is closed, as shown in FIG. 3C, the projection 5 extends through the restriction hole 16*a* of the protector 16 and the contact portion 5*a* comes into contact with the first contact portion 17*a* of the linking member 17, thus rotating the linking member 17 in the direction shown by the arrow H.

Consequently, the linking member 17 comes into contact with the switching portion 4*a* of the switch 4, so that the switch 4 is closed. Thus, the printer 1 becomes operative.

According to the present embodiment, with the above-described simple structure, the projection 5 can extend through the restriction hole 16*a* without being affected by manufacturing and structural variations, a space between the components, and the deformation of the components, thereby actuating the switch 4.

According to the present embodiment, the mechanism is designed so as to prevent a child's finger from entering a switch part, thus preventing an accidental operation caused by a child when the child accidentally inserts his or her finger into the switch part. Advantageously, the printer can be prevented from operating while a child accidentally inserts his or her finger into the switch part.

As described above, the present embodiment provides the inexpensive interlock switch mechanism which can prevent the operator from accidentally operating the switch and which is insusceptible to manufacturing and structural variations. In addition, the placement of the linking member 17 permits the switch 4 to be appropriately placed in a more favorable position. Accordingly, the interlock switch mechanism with higher design flexibility can be provided.

In the present embodiment, the linking member 17 includes a single rotatable component as shown in FIGS. 3A to 3C. If the linking member 17 includes two or more components or a linking mechanism, the same advantages as those in the present embodiment can be obtained. The interlock switch mechanism may be formed without the linking member 17 in a manner similar to the foregoing embodiment.

As described above, each of the embodiments of the present invention provides the inexpensive interlock switch mechanism which can prevent an operator including a child from accidentally operating the switch and which is insusceptible to manufacturing and structural variations.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-216697 filed Aug. 26, 2008, which is hereby incorporated by reference herein in its entirety.

What is claimed is:

1. An image forming apparatus comprising:

a main body of the apparatus;

an opening and closing member openably provided for the main body;

a switch configured to switch the apparatus between an electrically operating state and a non-operating state;

an actuating member configured to actuate the switch, wherein the switch is provided for either one of the main body and the opening and closing member and the actuating member is provided for the other one;

a protecting member configured to protect the switch, wherein the protecting member has an opening through which the actuating member passes; and a restricting member configured to restrict an object entering the opening of the protecting member, wherein the restricting member is placed between the protecting member and the switch and has an opening through which the actuating member passes, wherein the opening of the restricting member is smaller than the opening of the protecting member, wherein the restricting member is movable relative to the protecting member and the moving direction of the restricting member intersects the direction in which the actuating member passes through the opening of the restricting member.

2. The apparatus according to claim 1, wherein the moving direction of the restricting member is orthogonal to the direction in which the actuating member passes through the opening of the restricting member.

3. The apparatus according to claim 1, wherein the opening of the restricting member has a tapered portion, located adjacent to the protecting member, such that the tapered portion gradually reduces in the direction in which the actuating member enters the opening.

4. The apparatus according to claim 1, wherein the switch is provided for the main body and the actuating member is provided for the opening and closing member.

5. An image forming apparatus comprising:

a main body of the apparatus;

an opening and closing member openably provided for the main body;

a switch configured to switch the apparatus between an electrically operating state and a non-operating state;

an actuating member configured to actuate the switch, wherein the switch is provided for either one of the main body and the opening and closing member and the actuating member is provided for the other one; and a protecting member configured to protect the switch, wherein the protecting member has an opening through which the actuating member passes, wherein the actuating member is movable relative to the protecting member and the moving direction of the actuating member intersects the direction in which the actuating member passes through the opening of the protecting member.

6. The apparatus according to claim 5, wherein the moving direction of the actuating member is orthogonal to the direction in which the actuating member passes through the opening of the protecting member.

7. The apparatus according to claim 5, wherein the opening of the protecting member has a tapered portion, located on the side where the actuating member enters the opening, such that the tapered portion gradually reduces in the direction in which the actuating member enters the opening.

8. The apparatus according to claim 5, wherein the switch is provided for the main body and the actuating member is provided for the opening and closing member.

9. The apparatus according to claim 5, further comprising:

a linking member including a first contact portion with which the actuating member comes into contact and a second contact portion which comes into contact with the switch, wherein the actuating member comes into contact with the first contact portion to cause the linking member to move, so that the second contact portion presses the switch.

* * * * *